US012781636B2

(12) United States Patent
Krawciw et al.

(10) Patent No.: US 12,781,636 B2
(45) Date of Patent: Nov. 3, 2026

(54) COOLING RING FOR COMBUSTOR SYSTEM

(71) Applicant: Rolls-Royce plc, London (GB)

(72) Inventors: Jason Krawciw, Derby (GB); Carl L. Muldal, Derby (GB); Bharat R. Koli, Derby (GB); William Southgate, Derby (GB); Daniel J. Newman, Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 19/217,274

(22) Filed: May 23, 2025

(65) Prior Publication Data

US 2025/0383089 A1 Dec. 18, 2025

(30) Foreign Application Priority Data

Jun. 12, 2024 (GB) ..... 2408397

(51) Int. Cl.
*F01D 9/02* (2006.01)
*F23R 3/00* (2006.01)
*F23R 3/06* (2006.01)

(52) U.S. Cl.
CPC ..... *F01D 9/023* (2013.01); *F23R 3/002* (2013.01); *F23R 3/06* (2013.01); *F23R 2900/03044* (2013.01)

(58) Field of Classification Search
CPC . F01D 9/023; F23R 3/002; F23R 2900/03044
See application file for complete search history.

(56) References Cited

U.S. PATENT DOCUMENTS

| | | | | |
|---|---|---|---|---|
| 5,435,139 | A | 7/1995 | Pidcock et al. | |
| 5,598,697 | A | 2/1997 | Ambrogi et al. | |
| 6,347,508 | B1 | 2/2002 | Smallwood et al. | |
| 2002/0124572 | A1 | 9/2002 | Pidcock et al. | |
| 2007/0095067 | A1 * | 5/2007 | Alkabie | F01D 9/023 60/725 |

(Continued)

FOREIGN PATENT DOCUMENTS

| | | | |
|---|---|---|---|
| EP | 3960991 | A1 | 3/2022 |
| GB | 2021204 | A | 11/1979 |

OTHER PUBLICATIONS

Great Britain search report dated Nov. 28, 2024, issued in GB Patent Application No. 2408397.4.

(Continued)

*Primary Examiner* — Gerald L Sung

(57) ABSTRACT

A cooling ring for a combustor system having an inner wall, an outer wall spaced apart from the inner wall, and a discharge nozzle disposed downstream of the inner wall includes an upstream portion disposed adjacent to the outer wall, a downstream portion spaced apart from the upstream portion, and a middle portion connecting the upstream portion to the downstream portion. The middle portion includes a plurality of first apertures and a plurality of second apertures. Each first aperture extends from a first inner surface portion to an outer surface portion of the middle portion along a first aperture axis and is configured to supply a cooling fluid to a cavity. Each second aperture extends from the second inner surface portion to the outer surface portion along a second aperture axis and is configured to supply the cooling fluid to the discharge nozzles.

18 Claims, 7 Drawing Sheets

(56) References Cited

U.S. PATENT DOCUMENTS

| | | | | |
|---|---|---|---|---|
| 2015/0300645 | A1 | 10/2015 | Jopp et al. | |
| 2016/0177758 | A1 | 6/2016 | Clum et al. | |
| 2019/0107006 | A1* | 4/2019 | Propheter-Hinckley | F23R 3/002 |
| 2019/0218924 | A1 | 7/2019 | Mulcaire | |
| 2021/0207807 | A1 | 7/2021 | Ichihashi et al. | |
| 2022/0025773 | A1* | 1/2022 | Wada | F23R 3/06 |

OTHER PUBLICATIONS

European Search Report dated Aug. 21, 2025, issued in EP Patent Application No. 25175902.3.

* cited by examiner

COOLING RING FOR COMBUSTOR SYSTEM

CROSS-REFERENCE TO RELATED APPLICATIONS

This specification is based upon and claims the benefit of priority from United Kingdom patent application number GB 2408397.4 filed on Jun. 12, 2024, the entire contents of which is incorporated herein by reference.

BACKGROUND

Technical Field

This disclosure relates generally to gas turbine engines, and in particular, to a cooling ring, a combustor system including the cooling ring, and a gas turbine engine including the combustor system.

Description of the Related Art

Generally, a combustor system of a gas turbine engine includes one or more rows of combustor tiles and a cooling ring. The combustor tiles may thermally protect a combustor liner from hot combustion gases. The cooling ring may be configured to cool the combustor tiles and one or more discharge nozzles of the combustor system. However, as the gas turbine engine operates at non-benign environments, conventional cooling rings may fail to efficiently cool the combustor tiles, which may cause various defects in the combustor tiles. For example, defects such as cracking and oxidation may occur at a downstream portion of the combustor tiles due to the inefficient cooling provided by conventional cooling rings. Such defects may reduce an operational life of the combustor tiles as well as other components of the gas turbine engine.

SUMMARY

In a first aspect, there is provided a cooling ring for a combustor system having an inner wall, an outer wall spaced apart from the inner wall, and one or more discharge nozzles disposed downstream of the inner wall. The cooling ring includes an inner surface at least partially facing the inner wall and extending circumferentially about a central axis of the cooling ring. The cooling ring further includes an outer surface radially spaced apart from the inner surface and facing away from the inner wall. The cooling ring further includes an upstream portion extending along a first axis and disposed adjacent to the outer wall. The upstream portion abuts an outer downstream edge of the outer wall. The cooling ring further includes a downstream portion spaced apart from the upstream portion and extending along a second axis that is obliquely inclined to the first axis by a first inclination angle. The downstream portion extends beyond an inner downstream edge of the inner wall with respect to the second axis. The cooling ring further includes a middle portion connecting the upstream portion to the downstream portion. The middle portion, the upstream portion, and the downstream portion together form the inner surface and the outer surface. The middle portion includes a first inner surface portion adjacent to the upstream portion and partly forming the inner surface. The first inner surface portion extends along the first axis and faces the inner wall. The first inner surface portion supports a rear rail of the inner wall. The middle portion further includes a second inner surface portion partly forming the inner surface. The second inner surface portion extends from the first inner surface portion to the downstream portion along a third axis that is inclined to the first axis by a second inclination angle greater than the first inclination angle. The middle portion further includes an inner surface edge formed at an intersection between the first inner surface portion and the second inner surface portion. The middle portion further includes an outer surface portion partly forming the outer surface and extending between the upstream portion and the downstream portion. The middle portion further includes a plurality of first apertures circumferentially spaced apart from each other with respect to the central axis and extending through the middle portion. Each first aperture from the plurality of first apertures extends from the first inner surface portion to the outer surface portion along a first aperture axis. Each first aperture is disposed between the rear rail of the inner wall and the inner surface edge with respect to the first axis. Each first aperture is configured to supply a cooling fluid to a cavity defined between the inner wall and the cooling ring downstream of the rear rail of the inner wall. The middle portion further includes a plurality of second apertures circumferentially spaced apart from each other with respect to the central axis and extending through the middle portion. Each second aperture from the plurality of second apertures extends from the second inner surface portion to the outer surface portion along a second aperture axis that is inclined to the first aperture axis by a third inclination angle. Each second aperture is spaced apart from each first aperture and is configured to supply the cooling fluid to the one or more discharge nozzles.

The cooling ring may efficiently cool the inner wall and the one or more discharge nozzles. Specifically, the plurality of first apertures may direct the cooling fluid such that the cooling fluid directly impinges the inner wall. This may facilitate reducing a temperature of the inner wall, or more specifically, a downstream portion of the inner wall and prevent overheating thereof. Consequently, the cooling ring may reduce or prevent various defects, such as cracking and oxidation, in the inner wall. Additionally, the cooling fluid supplied by the plurality of first apertures may reduce or prevent entry of hot combustion gases into the cavity, thereby further reducing the temperature at the downstream portion of the inner wall.

Further, the plurality of second apertures may direct the cooling fluid onto the one or more discharge nozzles and one or more nozzle guide vanes. Additionally, the cooling fluid supplied by the plurality of second apertures may further reduce or prevent entry of the hot combustion gases into the cavity and an area around the cavity. The plurality of second apertures may also facilitate controlling a combustion chamber exit temperature traverse profile, thereby increasing the operational life of a turbine downstream of the cooling ring. Therefore, the plurality of first apertures and the plurality of second apertures may together help in reducing defects, such as, cracking and oxidation, which may be observed in inner walls of a conventional combustor system having a convention cooling ring. Thus, the cooling ring may improve the operational life and safety of the combustor system as well as other components of the gas turbine engine.

In some embodiments, the plurality of first apertures and the plurality of second apertures are staggered from each other, such that each first aperture is circumferentially disposed between a pair of adjacent second apertures from the plurality of second apertures with respect to the central axis. The staggered pattern may allow increasing the number of the first apertures and the number of the second apertures in the middle portion while maintaining a desired minimum distance between adjacent first and second apertures.

In some embodiments, each first aperture has a first diameter. Each second aperture has a second diameter that is larger than the first diameter.

In some embodiments, the second diameter is from 2.1 millimetres (mm) to 2.3 mm.

In some embodiments, the downstream portion has a ring downstream edge distal to the middle portion. Each second aperture defines a centre formed at an intersection between the second aperture axis and a plane of the second inner surface portion. A central axial distance between the ring downstream edge and the centre of each second aperture measured along the second axis is from 14.32 mm to 14.36 mm.

In some embodiments, an angle between the second aperture axis of each second aperture and a normal to the second axis is from 48 degrees to 52 degrees.

In some embodiments, each second aperture includes a second aperture upstream edge disposed proximal to the inner surface edge. Each second aperture further includes a second aperture downstream edge disposed distal to the inner surface edge. Each second aperture further includes a second inner upstream point formed at an intersection between the second aperture upstream edge and the second inner surface portion. Each second aperture further includes a second inner downstream point formed at an intersection between the second aperture downstream edge and the second inner surface portion. Each second aperture further includes a second outer upstream point formed at an intersection between the second aperture upstream edge and the outer surface portion.

In some embodiments, the downstream portion includes a downstream inner surface portion that partly forms the inner surface. The downstream inner surface portion includes an upstream boundary that is perpendicular to the second axis and demarcates the downstream inner surface portion from the second inner surface portion. A downstream axial distance between the upstream boundary and the second inner downstream point of each second aperture measured along the second axis is 0.732 mm.

In some embodiments, an inner distance between the inner surface edge and the second inner upstream point of each second aperture measured along the third axis is from 0.7 mm to 1.27 mm.

In some embodiments, the outer surface includes a rounded interface extending from the outer surface portion to the upstream portion. The rounded interface includes an interface upstream edge disposed adjacent to the upstream portion and an interface downstream edge disposed adjacent to the outer surface portion.

In some embodiments, each first aperture includes a first aperture downstream edge disposed proximal to the inner surface edge. Each first aperture further includes a first aperture upstream edge disposed distal to the inner surface edge. Each first aperture further includes a first inner upstream point formed at an intersection between the first aperture upstream edge and the first inner surface portion. Each first aperture further includes a first inner downstream point formed at an intersection between the first aperture downstream edge and the first inner surface portion.

In a second aspect, there is provided a combustor system for a gas turbine engine. The combustor system includes an inner wall including at least one row of combustor tiles. The inner wall further includes a rear rail extending radially outwards. The inner wall further includes an inner downstream edge spaced apart from the rear rail. The inner wall further includes an annular rear lip extending between the rear rail and the inner downstream edge along a lip axis. The combustor system further includes an outer wall spaced apart from the inner wall. The outer wall includes an outer downstream edge. The combustor system further includes one or more discharge nozzles disposed downstream of the inner wall. The combustor system further includes a cooling ring connected to the outer wall. The cooling ring includes an inner surface at least partially facing the inner wall and extending circumferentially about a central axis of the cooling ring. The cooling ring further includes an outer 20 surface radially spaced apart from the inner surface and facing away from the inner wall. The cooling ring further includes an upstream portion extending along a first axis and disposed adjacent to the outer wall. The upstream portion abuts the outer downstream edge of the outer wall. The cooling ring further includes a downstream portion spaced apart from the upstream portion and extending along a second axis that is obliquely inclined to the first axis by a first inclination angle. The downstream portion extends beyond the inner downstream edge of the inner wall with respect to the second axis. The cooling ring further includes a middle portion connecting the upstream portion to the downstream portion. The middle portion, the upstream portion, and the downstream portion together form the inner surface and the outer surface. The middle portion includes a first inner surface portion adjacent to the upstream portion and partly forming the inner surface. The first inner surface portion extends along the first axis and faces the inner wall. The first inner surface portion supports the rear rail of the inner wall. The annular rear lip and the first inner surface portion define a cavity therebetween. The middle portion further includes a second inner surface portion partly forming the inner surface. The second inner surface portion extends from the first inner surface portion to the downstream portion along a third axis that is inclined to the first axis by a second inclination angle greater than the first inclination angle. The middle portion further includes an inner surface edge formed at an intersection between the first inner surface portion and the second inner surface portion. The middle portion further includes an outer surface portion partly forming the outer surface and extending between the upstream portion and the downstream portion. The middle portion further includes a plurality of first apertures circumferentially spaced apart from each other with respect to the central axis and extending through the middle portion. Each first aperture from the plurality of first apertures extends from the first inner surface portion to the outer surface portion along a first aperture axis. Each first aperture is disposed between the rear rail of the inner wall and the inner surface edge with respect to the first axis. Each first aperture is configured to supply a cooling fluid to the cavity between the annular rear lip and the first inner surface portion. The middle portion further includes a plurality of second apertures circumferentially spaced apart from each other with respect to the central axis and extending through the middle portion. Each second aperture from the plurality of second apertures extends from the second inner surface portion to the outer surface portion along a second aperture axis that is inclined to the first aperture axis by a third inclination angle. Each second aperture is spaced apart from each first aperture and is configured to supply the cooling fluid to the one or more discharge nozzles.

The combustor system may have improved operational life and safety. Specifically, the cooling ring and the inner wall may improve the operational life and safety of the combustor system. The at least one row of combustor tiles may thermally protect the outer wall and the cooling ring from hot combustion gases. The cooling ring may efficiently cool the at least one row of combustor tiles and the one or more discharge nozzles.

The plurality of first apertures may direct the cooling fluid such that the cooling fluid directly impinges the inner wall, or more specifically, a cold side of the annular rear lip. This may facilitate reducing a temperature of the inner wall, or more specifically, a temperature of the annular rear lip, and prevent overheating thereof. Consequently, the cooling ring may reduce or prevent various defects, such as cracking and oxidation, in the inner wall. Additionally, the cooling fluid supplied by the plurality of first apertures may reduce or prevent entry of hot combustion gases into the cavity, thereby further reducing the temperature of the annular rear lip.

Further, the plurality of second apertures may direct the cooling fluid onto the one or more discharge nozzles. Additionally, the cooling fluid supplied by the plurality of second apertures may further reduce or prevent entry of the hot combustion gases into the cavity and an area around the cavity. The plurality of second apertures may also facilitate controlling a combustion chamber exit temperature traverse profile, thereby increasing an operational life of a turbine downstream of the cooling ring.

Therefore, the plurality of first apertures and the plurality of second apertures may together help in reducing defects, such as, cracking and oxidation, which may be observed in inner walls of a conventional combustor system having a convention cooling ring. The cooling ring and the inner wall may improve the safety and operational life of the combustor system, as well as other components of the gas turbine engine.

In some embodiments, the plurality of first apertures and the plurality of second apertures are staggered from each other, such that each first aperture is circumferentially disposed between a pair of adjacent second apertures from the plurality of second apertures with respect to the central axis.

In some embodiments, each first aperture has a first diameter. Each second aperture has a second diameter that is larger than the first diameter.

In some embodiments, the second diameter is from 2.1 mm to 2.3 mm.

In some embodiments, the downstream portion has a ring downstream edge distal to the middle portion. Each second aperture defines a centre formed at an intersection between the second aperture axis and a plane of the second inner surface portion. A central axial distance between the ring downstream edge and the centre of each second aperture measured along the second axis is from 14.32 mm to 14.36 mm.

In some embodiments, an angle between the second aperture axis of each second aperture and a normal to the second axis is from 48 degrees to 52 degrees.

In some embodiments, each second aperture includes a second aperture upstream edge disposed proximal to the inner surface edge. Each second aperture further includes a second aperture downstream edge disposed distal to the inner surface edge. Each second aperture further includes a second inner upstream point formed at an intersection between the second aperture upstream edge and the second inner surface portion. Each second aperture further includes a second inner downstream point formed at an intersection between the second aperture downstream edge and the second inner surface portion. Each second aperture further includes a second outer upstream point formed at an intersection between the second aperture upstream edge and the outer surface portion.

In some embodiments, the outer surface portion extends along the second axis.

In some embodiments, each discharge nozzle from the one or more discharge nozzles includes a birdmouth cavity that at least partially receives the downstream portion of the cooling ring therein. The birdmouth cavity may allow axial movement between the cooling ring and the one or more discharge nozzles.

In some embodiments, the annular rear lip has a lip overhang length between the rear rail and the inner downstream edge measured along the lip axis. The lip overhang length is at most 8.4 mm.

In some embodiments, the lip axis is parallel to the first axis.

In some embodiments, a lip extension distance between the inner surface edge and the inner downstream edge measured along the lip axis is at least 1.9 mm.

In some embodiments, each first aperture includes a first aperture downstream edge disposed proximal to the inner surface edge. Each first aperture further includes a first aperture upstream edge disposed distal to the inner surface edge. Each first aperture further includes a first inner upstream point formed at an intersection between the first aperture upstream edge and the first inner surface portion. Each first aperture further includes a first inner downstream point formed at an intersection between the first aperture downstream edge and the first inner surface portion.

In a third aspect, there is provided a gas turbine engine. The gas turbine engine includes a compressor. The gas turbine engine further includes a turbine disposed downstream of the compressor. The gas turbine engine further includes a combustor system configured to receive compressed air from the compressor and provide combustion products to the turbine. The combustor system includes an inner wall including at least one row of combustor tiles. The inner wall further includes a rear rail extending radially outwards. The inner wall further includes an inner downstream edge spaced apart from the rear rail. The inner wall further includes an annular rear lip extending between the rear rail and the inner downstream edge along a lip axis. The combustor system further includes an outer wall spaced apart from the inner wall. The outer wall includes an outer downstream edge. The combustor system further includes one or more discharge nozzles disposed downstream of the inner wall. The combustor system further includes a cooling ring connected to the outer wall. The cooling ring includes an inner surface at least partially facing the inner wall and extending circumferentially about a central axis of the cooling ring. The cooling ring further includes an outer surface radially spaced apart from the inner surface and facing away from the inner wall. The cooling ring further includes an upstream portion extending along a first axis and disposed adjacent to the outer wall. The upstream portion abuts the outer downstream edge of the outer wall. The cooling ring further includes a downstream portion spaced apart from the upstream portion and extending along a second axis that is obliquely inclined to the first axis by a first inclination angle. The downstream portion extends beyond the inner downstream edge of the inner wall with respect to the second axis. The cooling ring further includes a middle portion connecting the upstream portion to the downstream portion. The middle portion, the upstream portion, and the downstream portion together form the inner surface and the outer surface. The middle portion includes a first inner surface portion adjacent to the upstream portion and partly forming the inner surface. The first inner surface portion extends along the first axis and faces the inner wall. The first inner surface portion supports the rear rail of the inner wall. The annular rear lip and the first inner surface portion define a cavity therebetween. The middle portion further includes a second inner surface portion partly forming the inner surface. The second inner surface portion extends from the first inner surface portion to the downstream portion along a third axis that is inclined to the first axis by a second inclination angle greater than the first inclination angle. The middle portion further includes an inner surface edge formed at an intersection between the first inner surface portion and the second inner surface portion. The middle portion further includes an outer surface portion partly forming the outer surface and extending between the upstream portion and the downstream portion. The middle portion further includes a plurality of first apertures circumferentially spaced apart from each other with respect to the central axis and extending through the middle portion. Each first aperture from the plurality of second apertures extends from the first inner surface portion to the outer surface portion along a first aperture axis. Each first aperture is disposed between the rear rail of the inner wall and the inner surface edge with respect to the first axis. Each first aperture is configured to supply a cooling fluid to the cavity between the annular rear lip and the first inner surface portion. The middle portion further includes a plurality of second apertures circumferentially spaced apart from each other with respect to the central axis and extending through the middle portion. Each second aperture from the plurality of second apertures extends from the second inner surface portion to the outer surface portion along a second aperture axis that is inclined to the first aperture axis by a third inclination angle. Each second aperture is spaced apart from each first aperture and is configured to supply the cooling fluid to the one or more discharge nozzles.

The gas turbine engine (and components thereof) may have improved operational life and safety. Specifically, the cooling ring and the inner wall may improve the operational life and safety of the gas turbine engine. The at least one row of combustor tiles may thermally protect the outer wall and the cooling ring from hot combustion gases. The cooling ring may efficiently cool the at least one row of combustor tiles and the one or more discharge nozzles.

The plurality of first apertures may direct the cooling fluid such that the cooling fluid directly impinges the inner wall, or more specifically, a cold side of the annular rear lip. This may facilitate reducing a temperature of the inner wall, or more specifically, a temperature of the annular rear lip, and prevent overheating thereof. Consequently, the cooling ring may reduce or prevent various defects, such as cracking and oxidation, in the inner wall. Additionally, the cooling fluid supplied by the plurality of first apertures may reduce or prevent entry of hot combustion gases into the cavity, thereby further reducing the temperature of the annular rear lip.

Further, the plurality of second apertures may direct the cooling fluid onto the one or more discharge nozzles. Additionally, the cooling fluid supplied by the plurality of second apertures may further reduce or prevent entry of the hot combustion gases into the cavity and an area around the cavity. The plurality of second apertures may also facilitate controlling a combustion chamber exit temperature traverse profile, thereby increasing an operational life of a turbine downstream of the cooling ring. Therefore, the plurality of first apertures and the plurality of second apertures may together help in reducing defects, such as, cracking and oxidation, which may be observed in inner walls of a conventional combustor system having a convention cooling ring. The cooling ring and the inner wall may improve the safety and operational life of the combustor system, as well as other components of the gas turbine engine.

As noted elsewhere herein, the present disclosure may relate to a gas turbine engine. Such a gas turbine engine may comprise an engine core comprising a turbine, a combustor, a compressor, and a core shaft connecting the turbine to the compressor. Such a gas turbine engine may comprise a fan (having fan blades) located upstream of the engine core.

Arrangements of the present disclosure may be particularly, although not exclusively, beneficial for fans that are driven via a gearbox. Accordingly, the gas turbine engine may comprise a gearbox that receives an input from the core shaft and outputs drive to the fan so as to drive the fan at a lower rotational speed than the core shaft. The input to the gearbox may be directly from the core shaft, or indirectly from the core shaft, for example via a spur shaft and/or gear. The core shaft may rigidly connect the turbine and the compressor, such that the turbine and compressor rotate at the same speed (with the fan rotating at a lower speed). The gearbox may be a reduction gearbox (in that the output to the fan is a lower rotational rate than the input from the core shaft). Any type of gearbox may be used.

The gas turbine engine as described and/or claimed herein may have any suitable general architecture. For example, the gas turbine engine may have any desired number of shafts that connect turbines and compressors, for example one, two or three shafts. Purely by way of example, the turbine connected to the core shaft may be a first turbine, the compressor connected to the core shaft may be a first compressor, and the core shaft may be a first core shaft. The engine core may further comprise a second turbine, a second compressor, and a second core shaft connecting the second turbine to the second compressor. The second turbine, second compressor, and second core shaft may be arranged to rotate at a higher rotational speed than the first core shaft.

In such an arrangement, the second compressor may be positioned axially downstream of the first compressor. The second compressor may be arranged to receive (for example directly receive, for example via a generally annular duct) flow from the first compressor.

In any gas turbine engine as described and/or claimed herein, a combustor may be provided axially downstream of the fan and compressor(s). For example, the combustor may be directly downstream of (for example at the exit of) the second compressor, where a second compressor is provided. By way of further example, the flow at the exit to the combustor may be provided to the inlet of the second turbine, where a second turbine is provided. The combustor may be provided upstream of the turbine(s).

The or each compressor (for example the first compressor and second compressor as described above) may comprise any number of stages, for example multiple stages. Each stage may comprise a row of rotor blades and a row of stator vanes, which may be variable stator vanes (in that their angle of incidence may be variable). The row of rotor blades and the row of stator vanes may be axially offset from each other.

The or each turbine (for example the first turbine and second turbine as described above) may comprise any number of stages, for example multiple stages. Each stage may comprise a row of rotor blades and a row of stator vanes. The row of rotor blades and the row of stator vanes may be axially offset from each other.

Gas turbine engines in accordance with the present disclosure may have any desired bypass ratio, where the bypass ratio is defined as the ratio of the mass flow rate of the flow through the bypass duct to the mass flow rate of the flow through the core at cruise conditions. The bypass duct may be substantially annular. The bypass duct may be radially outside the engine core. The radially outer surface of the bypass duct may be defined by a nacelle and/or a fan case.

Specific thrust of an engine may be defined as the net thrust of the engine divided by the total mass flow through the engine. At cruise conditions, the specific thrust of an engine described and/or claimed herein may be less than (or on the order of) any of the following: 110 $Nkg^{-1}s$, 105 $Nkg^{-1}s$, 100 $Nkg^{-1}s$, 95 $Nkg^{-1}s$, 90 $Nkg^{-1}s$, 85 $Nkg^{-1}s$ or 80 $Nkg^{-1}s$. The specific thrust may be in an inclusive range bounded by any two of the values in the previous sentence (i.e., the values may form upper or lower bounds), for example in the range of from 80 $Nkg^{-1}s$ to 100 $Nkg^{-1}s$, or 85 $Nkg^{-1}s$ to 95 $Nkg^{-1}s$. Such engines may be particularly efficient in comparison with conventional gas turbine engines.

A fan blade and/or aerofoil portion of a fan blade described and/or claimed herein may be manufactured from any suitable material or combination of materials. For example, at least a part of the fan blade and/or aerofoil may be manufactured at least in part from a composite, for example a metal matrix composite and/or an organic matrix composite, such as carbon fibre.

The fan of a gas turbine as described and/or claimed herein may have any desired number of fan blades, for example 14, 16, 18, 20, 22, 24 or 26 fan blades.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

BRIEF DESCRIPTION OF THE DRAWINGS

Embodiments will now be described by way of example only, with reference to the Figures, in which.

DETAILED DESCRIPTION

Aspects and embodiments of the present disclosure will now be discussed with reference to the accompanying figures. Further aspects and embodiments will be apparent to those skilled in the art.

Figure 1:
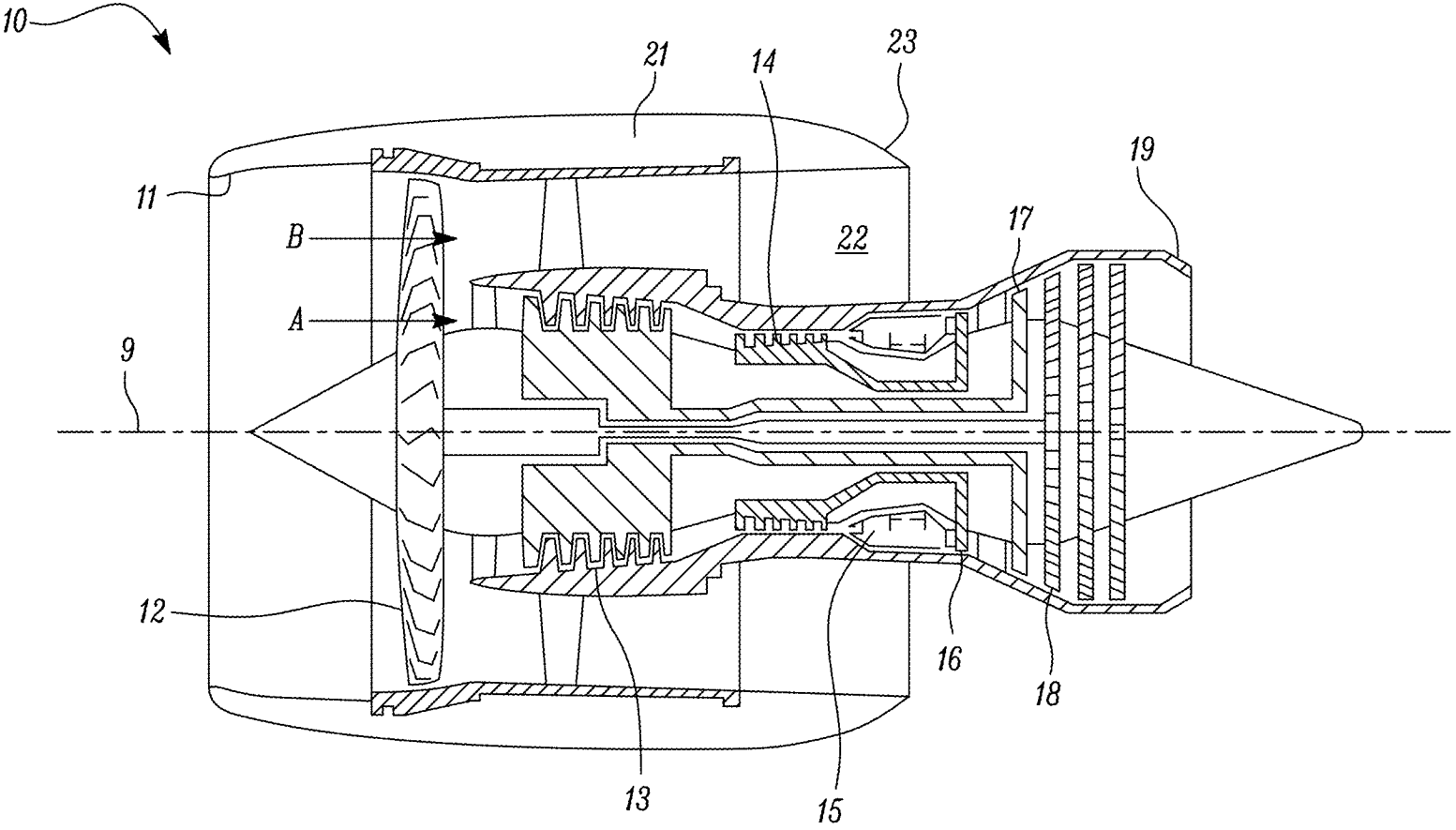
FIG. 1 shows a sectional side view of a gas turbine engine.

FIG. 1 shows a gas turbine engine 10 having a principal rotational axis 9. The geometry of the gas turbine engine 10, and components thereof, is defined by a conventional axis system, comprising an axial direction (which is aligned with the principal rotational axis 9), a radial direction (in the bottom-to-top direction in FIG. 1), and a circumferential direction (perpendicular to the page in the FIG. 1 view). The axial, radial, and circumferential directions are mutually perpendicular. Furthermore, the terms "upstream" and "downstream" are defined with respect to the general direction of gas flow through the gas turbine engine 10, that is, from left to right as viewed in FIG. 1. A component "A" being upstream of a component "B" means that the component "A" is positioned to the left of the component "B," as viewed in FIG. 1. A component "C" being downstream of a component "D" means that the component "C" is positioned to the right of the component "D," as viewed in FIG. 1.

The gas turbine engine 10 includes, in axial flow series, an intake 11, a fan 12, an intermediate pressure compressor 13, a high pressure compressor 14, combustion equipment 15, a high pressure turbine 16, an intermediate pressure turbine 17, a low pressure turbine 18, and an engine core exhaust nozzle 19. In other words, the gas turbine engine 10 includes the compressor(s) 13, 14 and the turbine(s) 16, 17, 18 disposed downstream of the compressor 13, 14. A nacelle 21 generally surrounds the gas turbine engine 10 and defines the intake 11, a bypass duct 22, and a bypass exhaust nozzle 23.

During operation, air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the first air flow A directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive the high, intermediate, and low pressure turbines 16, 17, 18 before being exhausted through the engine core exhaust nozzle 19 to provide additional propulsive thrust. The high, intermediate, and low pressure turbines 16, 17, 18 respectively drive the high and intermediate pressure compressors 14, 13, and the fan 12 by suitable interconnecting shafts.

Figure 2:
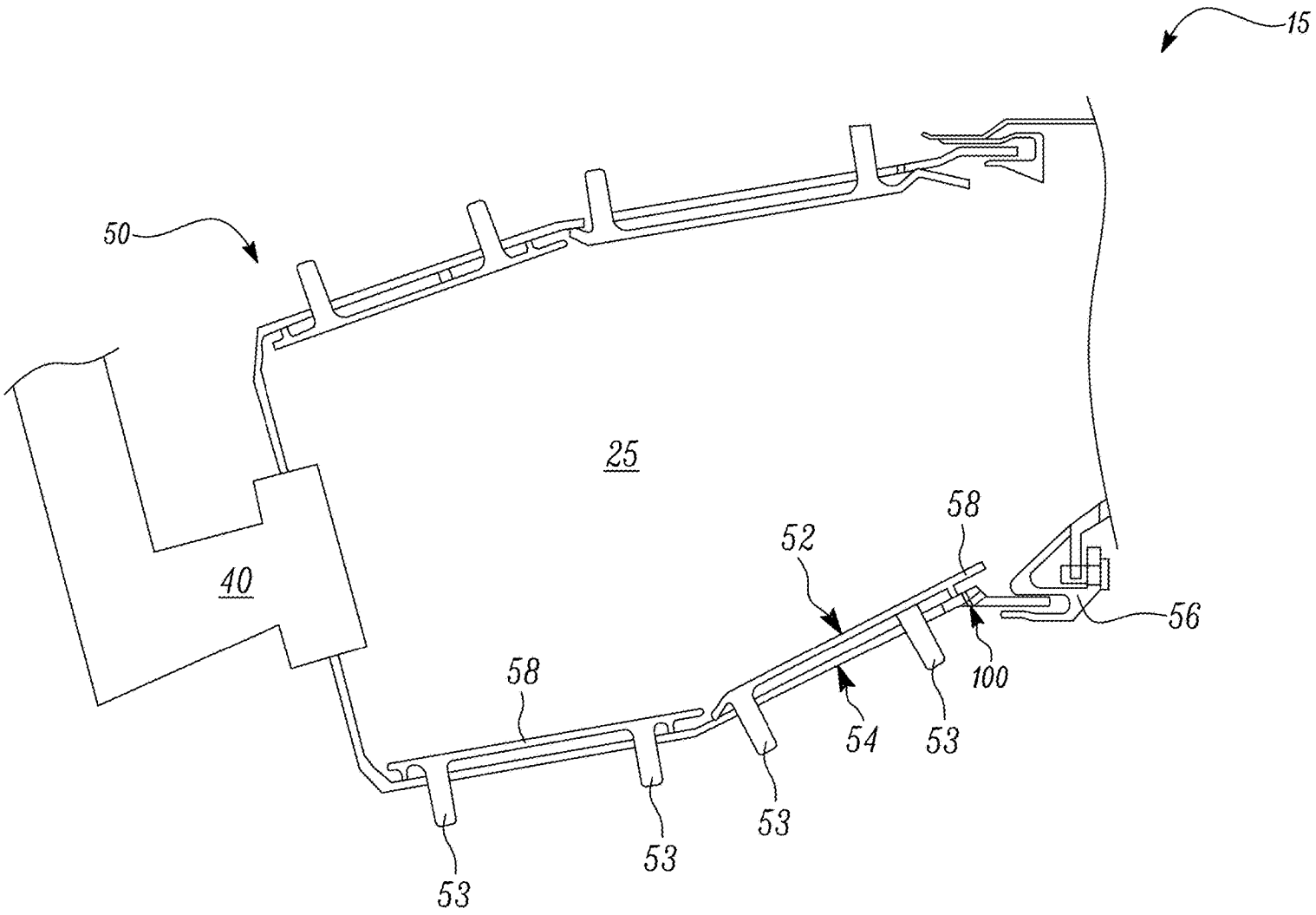
FIG. 2 shows a cross-sectional view of a portion of a combustor system for the gas turbine engine of FIG. 1 in accordance with an embodiment of the present disclosure.

FIG. 2 shows a cross-sectional diagram of a portion of a combustor system 50 for a gas turbine engine (e.g., the gas turbine engine 10 of FIG. 1). Specifically, the gas turbine engine 10 may include the combustor system 50. More specifically, the combustion equipment 15 of the gas turbine engine 10 may include the combustor system 50. The combustor system 50 may be configured to receive the compressed air from the compressor 13, 14 and provide the combustion products to the turbine 16, 17, 18.

The combustor system 50 includes an inner wall 52 and an outer wall 54 spaced apart from the inner wall 52. Each of the inner wall 52 and the outer wall 54 may be segmented or non-segmented.

The outer wall 54 may generally circumferentially surround the inner wall 52. The inner wall 52 may be connected to the outer wall 54. In an embodiment, the combustor system 50 may further include a plurality of fasteners 53, for example, threaded studs, connecting the inner wall 52 to the outer wall 54. The plurality of fasteners 53 may be cast integrally with the inner wall 52 or may be secured to the inner wall 52 by welding, brazing, and the like. Other coupling methods may also be employed to connect the inner wall 52 to the outer wall 54.

The inner wall 52 may define a combustion chamber 25. The combustor system 50 may further include a fuel injector 40 disposed in fluid communication with the combustion chamber 25. A fuel from the fuel injector 40 and compressed air from the high pressure compressor 14 (shown in FIG. 1) may be mixed and combusted in the combustion chamber 25.

The inner wall 52 may thermally protect the outer wall 54 from hot combustion gases. In an embodiment, the outer wall 54 may be a combustor liner. In an embodiment, the inner wall 52 includes at least one row of combustor tiles 58. In such embodiments, the at least one row of combustor tiles 58 may thermally protect the outer wall 54 from the hot combustion gases. In the illustrated embodiment of FIG. 2, the inner wall 52 includes two rows of combustor tiles 58.

The combustor system 50 further includes one or more discharge nozzles 56 disposed downstream of the inner wall 52. The one or more discharge nozzles 56 may be any annular sealing structures positioned to add radial and axial support to the outer wall 54. The one or more discharge nozzles 56 may further support one or more nozzle guide vanes (not shown).

Figure 3:
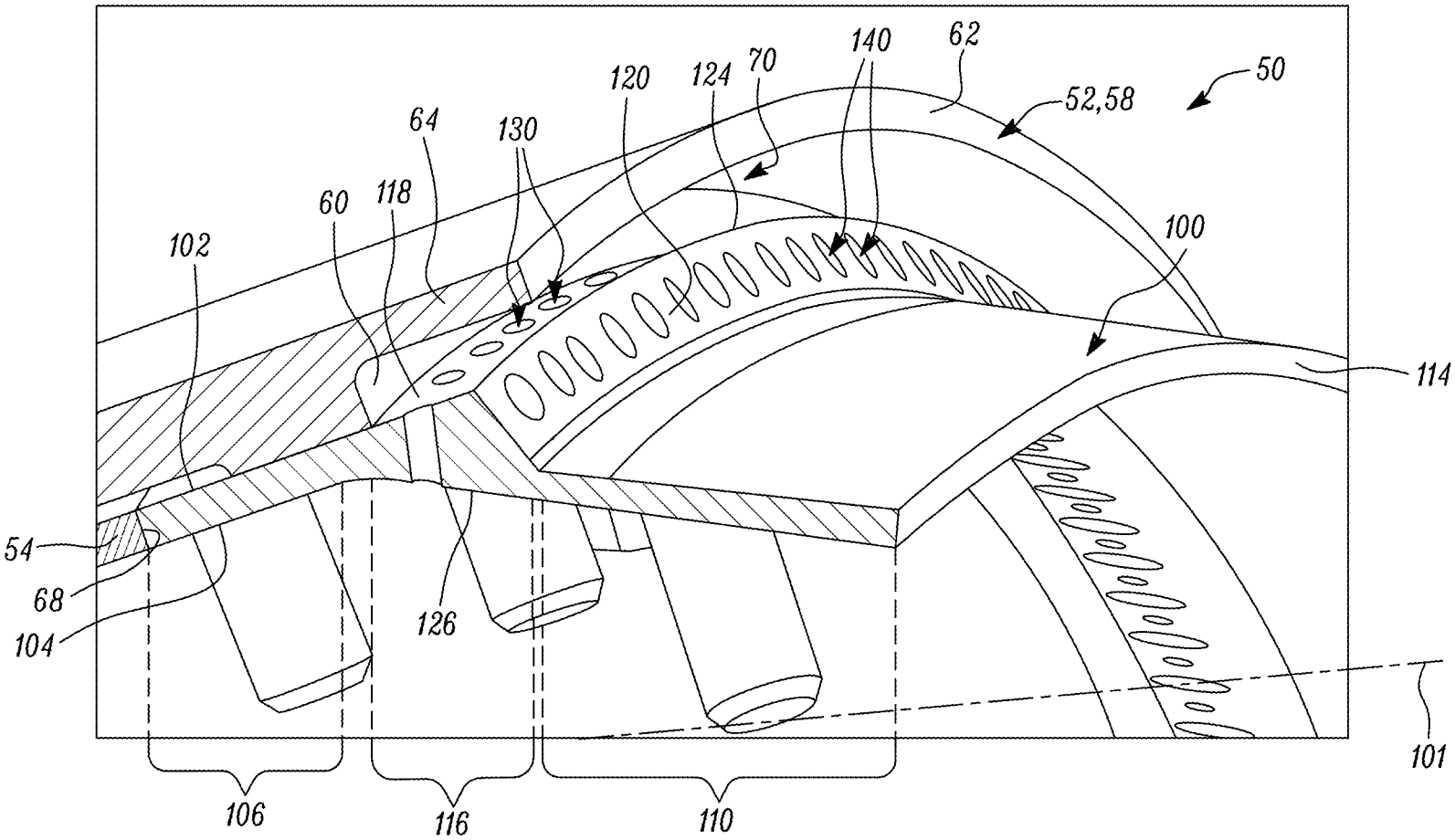
FIG. 3 shows a cross-sectional perspective view of a portion of the combustor system of FIG. 2.
Figure 4:
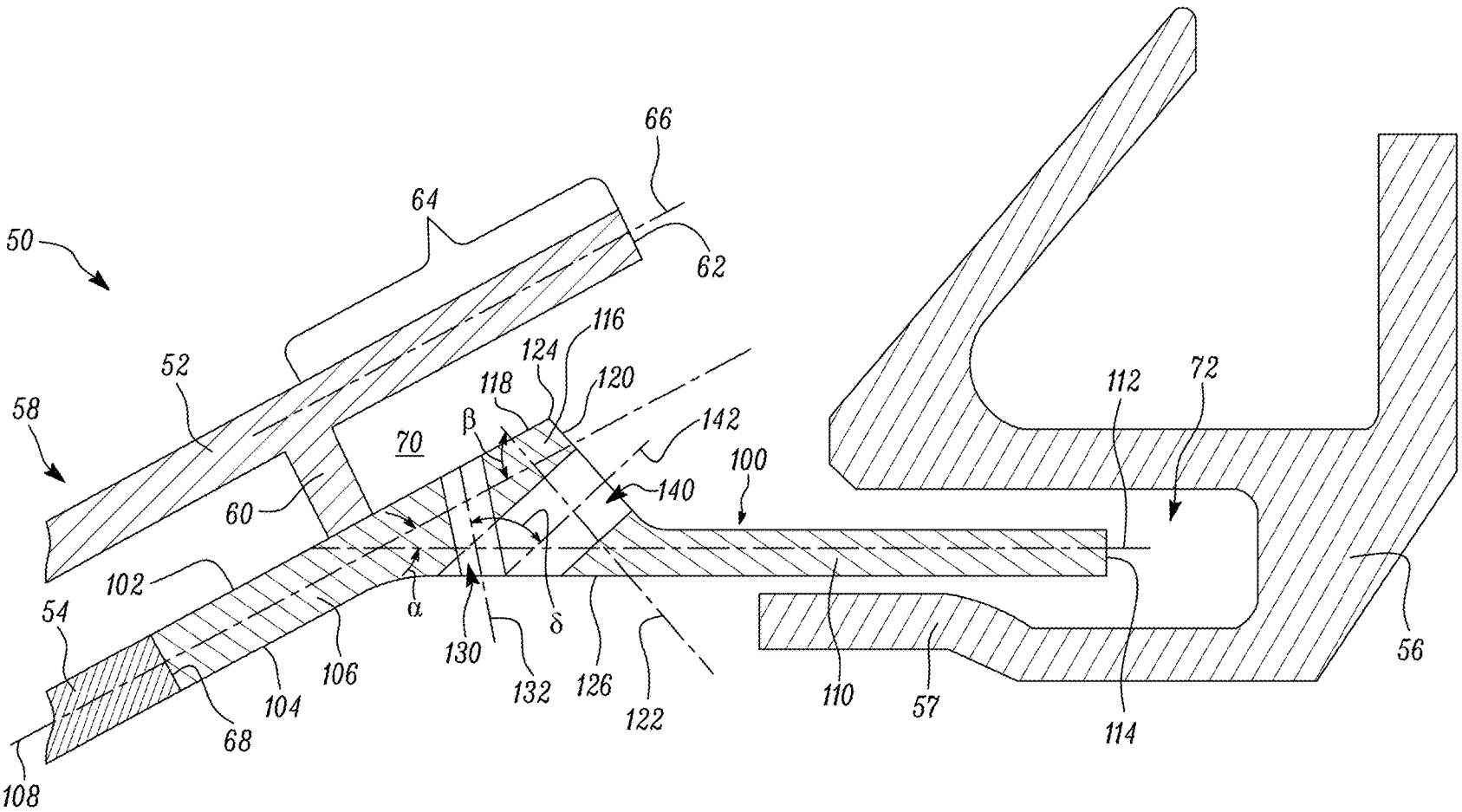
FIG. 4 shows a cross-sectional diagram of a portion of the combustor system.

FIG. 3 shows a cross-sectional perspective view of a portion of the combustor system 50 in accordance with an embodiment of the present disclosure. FIG. 4 shows a cross-sectional diagram of a portion of the combustor system 50 in accordance with an embodiment of the present disclosure.

Referring to FIGS. 3 and 4, the inner wall 52 may include a rear rail 60 extending radially outwards. The inner wall 52 may further include an inner downstream edge 62 spaced apart from the rear rail 60. The inner wall 52 may further include an annular rear lip 64 extending between the rear rail 60 and the inner downstream edge 62 along a lip axis 66 (shown in FIG. 4). Moreover, the outer wall 54 includes an outer downstream edge 68.

The combustor system 50 further includes a cooling ring 100. The cooling ring 100 may abut the outer wall 54 at the outer downstream edge 68. In some embodiments, the cooling ring 100 may be connected to the outer wall 54. For example, the cooling ring 100 may be connected to the outer wall 54 at the outer downstream edge 68 via welding or other fastening means.

The cooling ring 100 includes an inner surface 102 at least partially facing the inner wall 52 and extending circumferentially about a central axis 101 (shown in FIG. 3) of the cooling ring 100. The cooling ring 100 further includes an outer surface 104 radially spaced apart from the inner surface 102 and facing away from the inner wall 52.

The cooling ring 100 further includes an upstream portion 106 extending along a first axis 108 (shown in FIG. 4) and disposed adjacent to the outer wall 54. Specifically, the upstream portion 106 abuts the outer downstream edge 68 of the outer wall 54. The upstream portion 106 may be connected to the outer wall 54.

The cooling ring 100 further includes a downstream portion 110 spaced apart from the upstream portion 106 and extending along a second axis 112 (shown in FIG. 4). The second axis 112 is obliquely inclined to the first axis 108 by a first inclination angle $\alpha$. The downstream portion 110 may extend opposite to the upstream portion 106 along the second axis 112. The downstream portion 110 extends beyond the inner downstream edge 62 of the inner wall 52 with respect to the second axis 112. The downstream portion 110 may have a ring downstream edge 114. The ring downstream edge 114 may be the most downstream edge of the cooling ring 100.

In an embodiment, each discharge nozzle 56 from the one or more discharge nozzles 56 may include a birdmouth cavity 72 that at least partially receives the downstream portion 110 of the cooling ring 100 therein. The ring downstream edge 114 may be located within the birdmouth cavity 72. Each discharge nozzle 56 may include an inner leg 57 extending towards the cooling ring 100 along the second axis 112. The inner leg 57 may partially define the birdmouth cavity 72. The birdmouth cavity 72 may allow axial movement between the cooling ring 100 and the one or more discharge nozzles 56.

The cooling ring 100 further includes a middle portion 116 connecting the upstream portion 106 to the downstream portion 110. The middle portion 116, the upstream portion 106, and the downstream portion 110 together form the inner surface 102 and the outer surface 104. The ring downstream edge 114 may be distal to the middle portion 116.

The middle portion 116 includes a first inner surface portion 118 adjacent to the upstream portion 106 and partly forming the inner surface 102. The first inner surface portion 118 extends along the first axis 108 and faces the inner wall 52. A cavity 70 (shown in FIG. 4) may be defined between the inner wall 52 and the cooling ring 100 downstream of the rear rail 60 of the inner wall 52. Specifically, the annular rear lip 64 and the first inner surface portion 118 may define the cavity 70 therebetween.

The first inner surface portion 118 supports the rear rail 60 of the inner wall 52. The first inner surface portion 118 may at least partially support the rear rail 60. In some embodiments, the first inner surface portion 118 and the inner surface 102 corresponding to the upstream portion 106 may together support the rear rail 60. In an embodiment, the rear rail 60 may isolate the cavity 70 from a space defined between the inner wall 52 and the outer wall 54 upstream of the rear rail 60.

The middle portion 116 further includes a second inner surface portion 120 partly forming the inner surface 102. The second inner surface portion 120 extends from the first inner surface portion 118 to the downstream portion 110 along a third axis 122 (shown in FIG. 4). The third axis 122 is inclined to the first axis 108 by a second inclination angle $\beta$ that is greater than the first inclination angle $\alpha$.

The middle portion 116 further includes an inner surface edge 124 formed at an intersection between the first inner surface portion 118 and the second inner surface portion 120. The middle portion 116 further includes an outer surface portion 126 partly forming the outer surface 104 and extending between the upstream portion 106 and the downstream portion 110. In an embodiment, the outer surface portion 126 may extend along the second axis 112. The first inner surface portion 118, the second inner surface portion 120, and the outer surface portion 126 may define a triangular cross-sectional shape of the middle portion 116.

The middle portion 116 further includes a plurality of first apertures 130 circumferentially spaced apart from each other with respect to the central axis 101 and extending through the middle portion 116. Each first aperture 130 from the plurality of first apertures 130 extends from the first inner surface portion 118 to the outer surface portion 126 along a first aperture axis 132 (shown in FIG. 4). Each first aperture 130 is disposed between the rear rail 60 of the inner wall 52 and the inner surface edge 124 with respect to the first axis 108. Each first aperture 130 is configured to supply a cooling fluid to the cavity 70 defined between the inner wall 52 and the cooling ring 100 downstream of the rear rail 60 of the inner wall 52. Specifically, each first aperture 130 is configured to supply the cooling fluid to the cavity 70 between the annular rear lip 64 and the first inner surface portion 118.

The middle portion 116 further includes a plurality of second apertures 140 circumferentially spaced apart from each other with respect to the central axis 101 and extending through the middle portion 116. Each second aperture 140 from the plurality of second apertures 140 extends from the second inner surface portion 120 to the outer surface portion 126 along a second aperture axis 142 (shown in FIG. 4) that is inclined to the first aperture axis 132 by a third inclination angle δ. Each second aperture 140 is spaced apart from each first aperture 130 and is configured to supply the cooling fluid to the one or more discharge nozzles 56.

It should be noted that the first aperture 130 and the second aperture 140 are depicted as coinciding in FIG. 4 only for ease of illustration and explanation. In some embodiments, the plurality of first apertures 130 and the plurality of second apertures 140 may be staggered from each other, as will be discussed below with reference to FIGS. 5A and 5B.

The cooling ring 100 may efficiently cool the inner wall 52 and the one or more discharge nozzles 56. Specifically, the plurality of first apertures 130 may direct the cooling fluid such that the cooling fluid directly impinges the inner wall 52. More specifically, the plurality of first apertures 130 may direct the cooling fluid such that the cooling fluid directly impinges a cold side of the annular rear lip 64. This may facilitate reducing a temperature of the inner wall 52, or more specifically, the annular rear lip 64, and prevent overheating thereof. This may reduce or prevent various defects, such as cracking and oxidation, in the inner wall 52. Additionally, the cooling fluid supplied by the plurality of first apertures 130 may reduce or prevent entry of the hot combustion gases into the cavity 70, thereby further reducing the temperature of the the annular rear lip 64.

Further, the plurality of second apertures 140 may direct the cooling fluid onto the one or more discharge nozzles 56 and the one or more nozzle guide vanes (not shown) downstream of the one or more discharge nozzles 56. Additionally, the cooling fluid supplied by the plurality of second apertures 140 may further reduce or prevent entry of the hot combustion gases into the cavity 70 and an area around the cavity 70. The plurality of second apertures 140 may also facilitate controlling a combustion chamber exit temperature traverse profile, thereby increasing an operational life of the turbine(s) 16, 17, 18 (shown in FIG. 1).

Therefore, the plurality of first apertures 130 and the plurality of second apertures 140 may together help in reducing defects, such as, cracking and oxidation, which may be observed in inner walls of a conventional combustor system having a conventional cooling ring. Thus, the cooling ring 100 may improve the operational life and safety of the combustor system 50, as well as other components of the gas turbine engine 10.

Figure 5B:
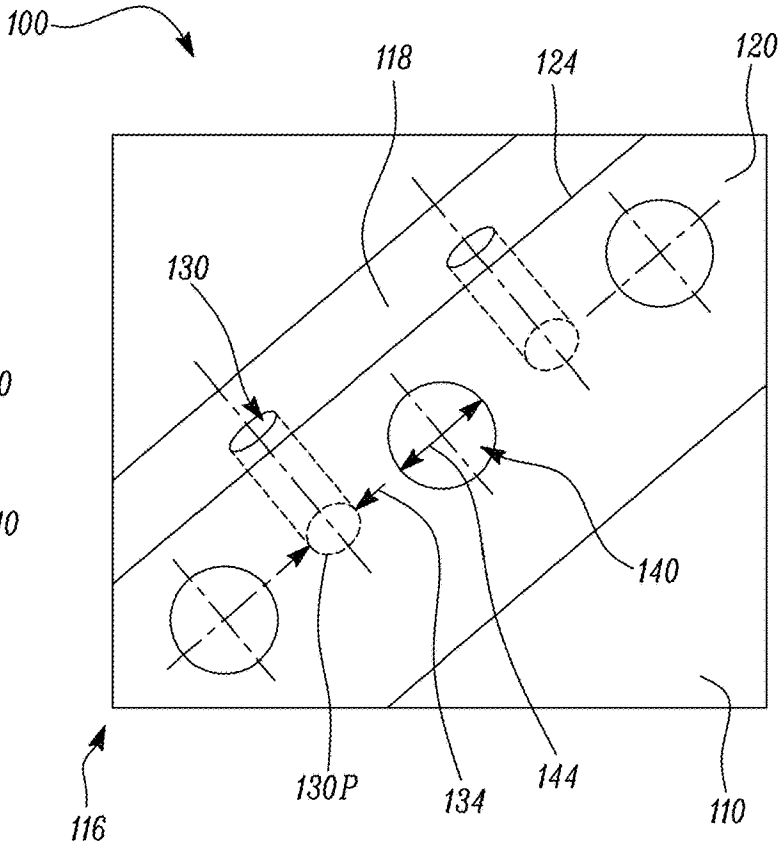
FIG. 5B shows a top perspective diagram of a portion of the cooling ring.
Figure 5A:
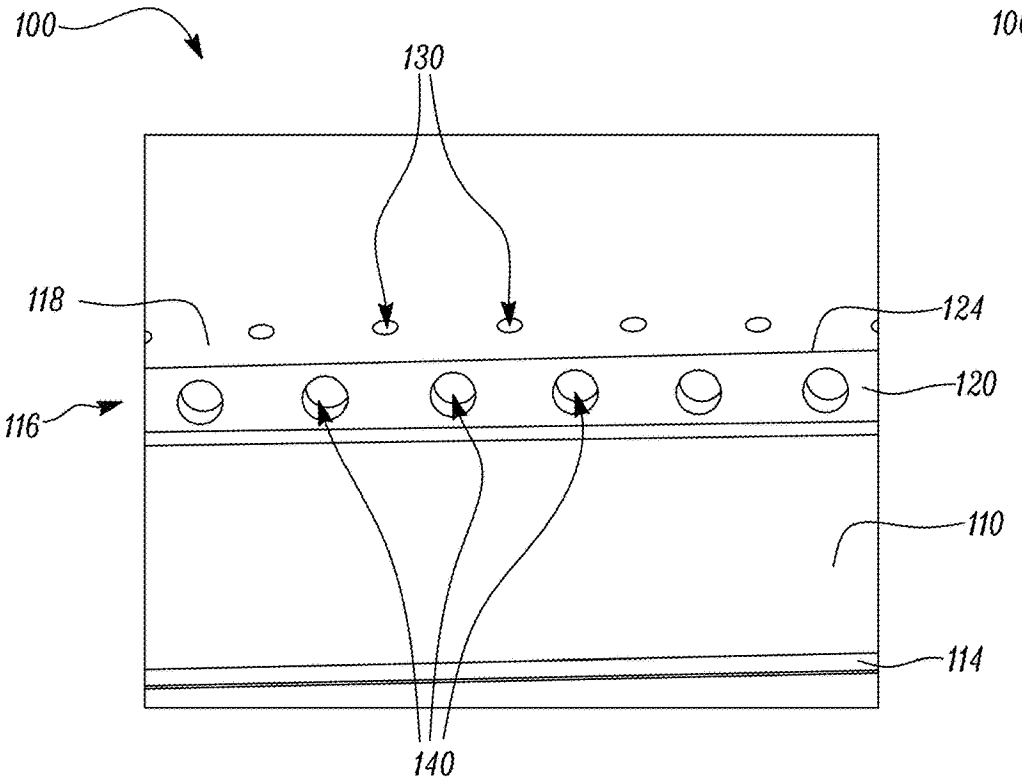
FIG. 5A shows a rear perspective view of a portion of a cooling ring of the combustor system.

FIGS. 5A and 5B show portions of the cooling ring 100 in accordance with an embodiment of the present disclosure. Specifically, FIG. 5A shows a rear perspective view of a portion of the cooling ring 100 and FIG. 5B shows a top perspective diagram of a portion of the cooling ring 100. In FIG. 5B, projections 130P of the plurality of first apertures 130 onto the second inner surface portion 120 of the middle portion 116 are shown.

Referring to FIGS. 3, 5A, and 5B, in an embodiment, the plurality of first apertures 130 and the plurality of second apertures 140 are staggered from each other, such that each first aperture 130 is circumferentially disposed between a pair of adjacent second apertures 140 from the plurality of second apertures 140 with respect to the central axis 101. This staggered pattern may allow increasing the number of the first apertures 130 and the number of the second apertures 140 in the middle portion 116 while maintaining a desired minimum distance between adjacent first and second apertures 130, 140.

In an embodiment, each first aperture 130 may have a first diameter 134. Each second aperture 140 may have a second diameter 144. In some embodiments, the second diameter 144 is larger than the first diameter 134. In some embodiments, the second diameter 144 may be equal to the first diameter 134. In some embodiments, the second diameter 144 may be less than the first diameter 134. In some embodiments, the second diameter 144 may be from 2.1 millimetres (mm) to 2.3 mm.

Referring back to FIG. 4, the combustor system 50 may be designed as a micro-system. That is, components of the combustor system 50 (such as the inner wall 52, the cooling ring 100, and the one or more discharge nozzles 56) may be designed together as a micro-system. For instance, the inner wall 52 and the cooling ring 100 may be designed such that the plurality of first apertures 130 of the cooling ring 100 do not get blocked by the rear rail 60 of the inner wall 52. Further, the inner wall 52 and the cooling ring 100 may be designed such that the cooling fluid supplied by the plurality of first apertures 130 is directed to the annular rear lip 64, and does not enter directly into the combustion chamber 25 (shown in FIG. 2).

Furthermore, the cooling ring 100 and the one or more discharge nozzles 56 may be designed such that the inner leg 57 does not block the plurality of first apertures 130 and/or the plurality of second apertures 140. Specifically, the cooling ring 100 and the one or more discharge nozzles 56 may be designed to ensure that a distance between each first aperture 130 and the inner leg 57 remains greater than 0 mm under all operational conditions and tolerances, as well as a distance between each second aperture 140 and the inner leg 57 remains greater than 0 mm under all operational conditions and tolerances. Therefore, under adverse tolerances, thermal movements, and downstream movements due to pin bush/boss wear, the inner leg 57 may not block the plurality of first apertures 130 and the plurality of second apertures 140. The outer surface 104 at the downstream portion 110 of the cooling ring 100 may be designed to be planar to provide the space for axial movement and reduce the risk of a clash between the cooling ring 100 and the inner leg 57.

Other design parameters of the combustor system 50 will be discussed in greater detail with reference to FIGS. 6 and 7.

Figure 6:
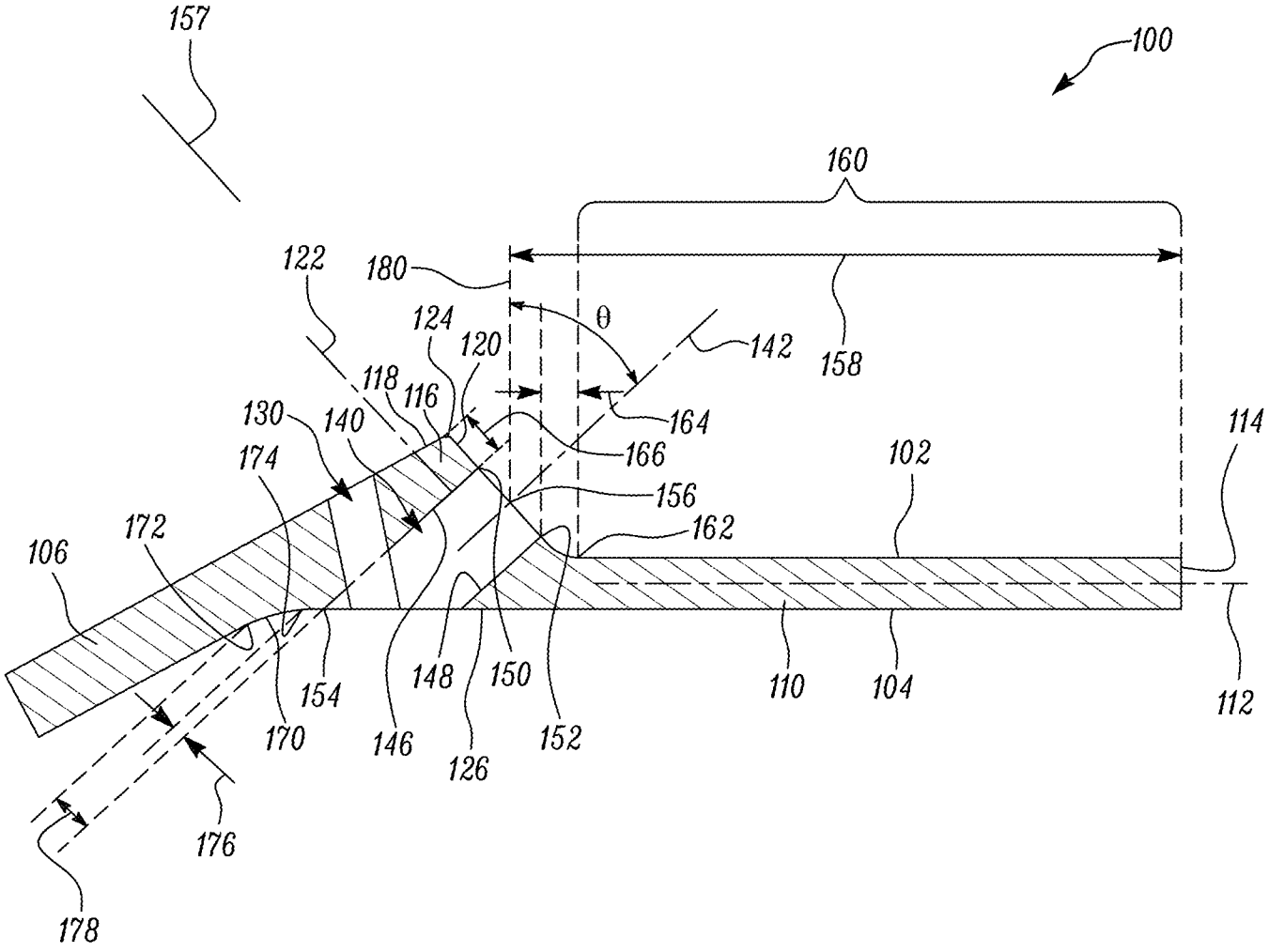
FIG. 6 shows a cross-sectional diagram of a portion of the cooling ring.

FIG. 6 shows a cross-sectional diagram of a portion of the cooling ring 100 in accordance with an embodiment of the present disclosure.

An angle θ may be defined between the second aperture axis 142 of each second aperture 140 and a normal 180 to the second axis 112. In some embodiments, the angle θ may be from 48 degrees to 52 degrees. The angle θ may be adjusted such that each second aperture 140 efficiently supplies a maximum amount of the cooling fluid to the one or more discharge nozzles 56 (shown in FIG. 4).

In an embodiment, each second aperture 140 may define a centre 156 formed at an intersection between the second aperture axis 142 and a plane 157 (depicted by a line in FIG. 6) of the second inner surface portion 120. A central axial distance 158 between the ring downstream edge 114 and the centre 156 of each second aperture 140 may be measured along the second axis 112. In some embodiments, the central axial distance 158 may be from 14.32 mm to 14.36 mm.

In an embodiment, each second aperture 140 may include a second aperture upstream edge 146 disposed proximal to the inner surface edge 124. Each second aperture 140 may further include a second aperture downstream edge 148 disposed distal to the inner surface edge 124. Each second aperture 140 may further include a second inner upstream point 150 formed at an intersection between the second aperture upstream edge 146 and the second inner surface portion 120. Each second aperture 140 may further include a second inner downstream point 152 formed at an intersection between the second aperture downstream edge 148 and the second inner surface portion 120. An inner distance 166 between the inner surface edge 124 and the second inner upstream point 150 of each second aperture 140 may be measured along the third axis 122. In some embodiments, the inner distance 166 may be from 0.7 mm to 1.27 mm. The inner distance 166 may ensure that each second aperture 140 is positioned on the second inner surface portion 120.

In an embodiment, the downstream portion 110 may include a downstream inner surface portion 160 that partly forms the inner surface 102. The downstream inner surface portion 160 may include an upstream boundary 162 that is perpendicular to the second axis 112 and demarcates the downstream inner surface portion 160 from the second inner surface portion 120. A downstream axial distance 164 between the upstream boundary 162 and the second inner downstream point 152 of each second aperture 140 may be measured along the second axis 112. In some embodiments, the downstream axial distance 164 may be 0.732 mm. In some embodiments, the downstream axial distance 164 may be greater than 0.732 mm. The downstream axial distance 164 being 0.732 mm or greater may ensure that each second aperture 140 is located on the second inner surface portion 120 and does not encroach onto the downstream inner surface portion 160. This may reduce stress in the downstream portion 110.

In an embodiment, the outer surface 104 may include a rounded interface 170 extending from the outer surface portion 126 to the upstream portion 106. The rounded interface 170 may include an interface upstream edge 172 disposed adjacent to the upstream portion 106 and an interface downstream edge 174 disposed adjacent to the outer surface portion 126. The rounded interface 170 may provide a smooth transition between the middle portion 116 and the upstream portion 106 of the cooling ring 100, and reduce stress. In some embodiments, the rounded interface 170 may have a radius of 3 millimetres.

Each second aperture 140 may further include a second outer upstream point 154 formed at an intersection between the second aperture upstream edge 146 and the outer surface portion 126. A first outer distance 176 between the interface downstream edge 174 and the second outer upstream point 154 of each second aperture 140 may be measured along the third axis 122. In some embodiments, the first outer distance 176 may be 0.294 mm. The first outer distance 176 may ensure that each second aperture 140 does not encroach onto the rounded interface 170, thereby ensuring that the rounded interface 170 provides the smooth transition for stress reduction. However, under adverse tolerances, the second outer upstream point 154 may be upstream of the interface downstream edge 174, but downstream of the interface upstream edge 172. Specifically, a second outer distance 178 between the interface upstream edge 172 and the second outer upstream point 154 of each second aperture 140 may be measured along the third axis 122. In some embodiments, the second outer distance 178 may be 0.919 mm.

Figure 7:
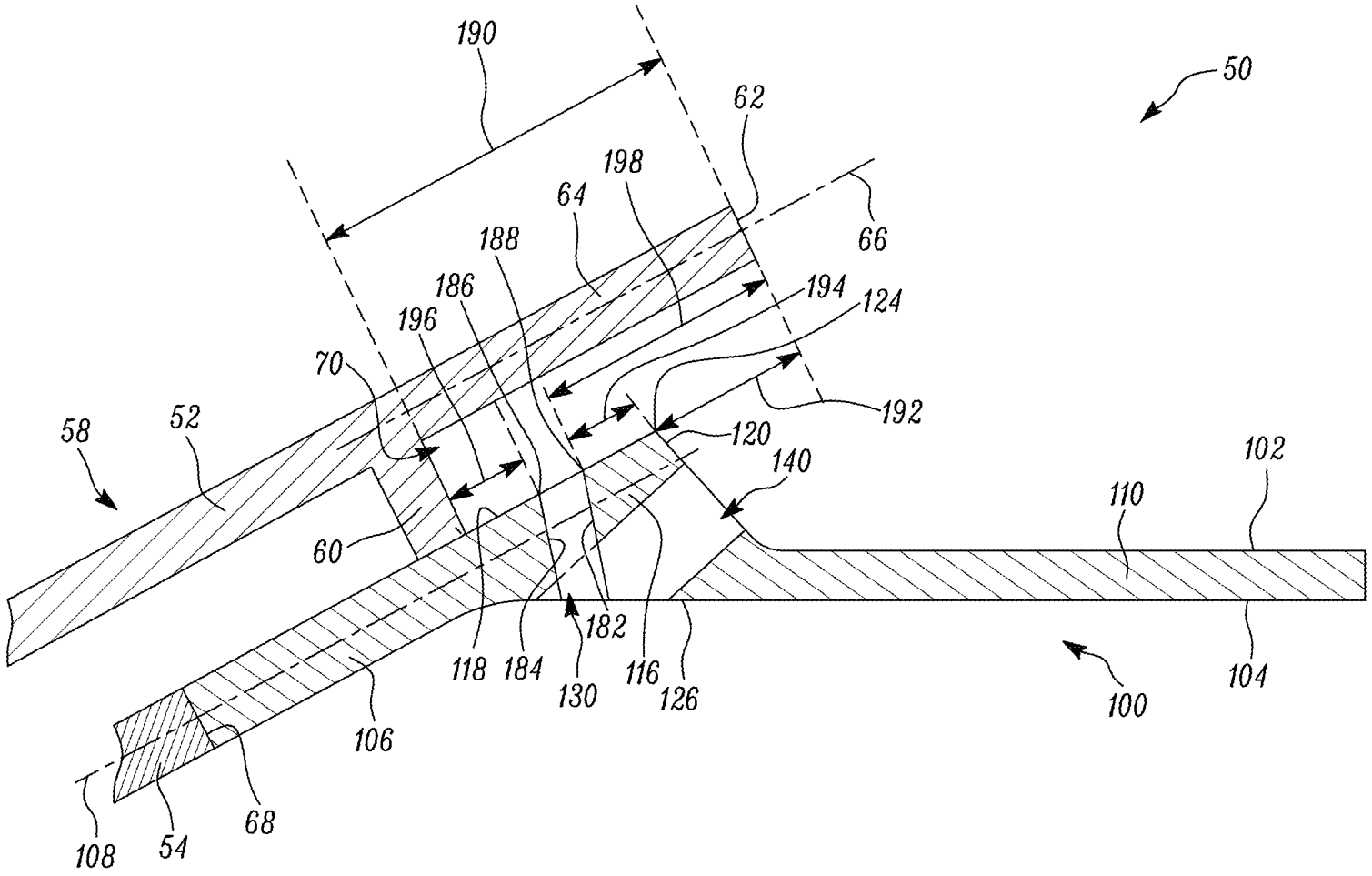
FIG. 7 shows a cross-sectional diagram of a portion of the combustor system.

FIG. 7 shows a cross-sectional diagram of a portion of the combustor system 50 in accordance with an embodiment of the present disclosure.

The annular rear lip 64 may have a lip overhang length 190 between the rear rail 60 and the inner downstream edge 62 measured along the lip axis 66. The lip overhang length 190 may be optimized to prevent overheating of the annular rear lip 64 due to exposure to the hot combustion gases and provide adequate coverage for the outer wall 54 and the cooling ring 100. In some embodiments, the lip overhang length 190 may be at most 8.4 mm.

A lip extension distance 192 between the inner surface edge 124 and the inner downstream edge 62 may be measured along the lip axis 66. In some embodiments, the lip extension distance 192 may be at least 1.9 mm. The lip extension distance 192 may be optimized to reduce or prevent entry of the hot combustion gases into the cavity 70.

Further, each first aperture 130 may include a first aperture downstream edge 182 disposed proximal to the inner surface edge 124. Each first aperture 130 may further include a first aperture upstream edge 184 disposed distal to the inner surface edge 124. Each first aperture 130 may further include a first inner upstream point 186 formed at an intersection between the first aperture upstream edge 184 and the first inner surface portion 118. Each first aperture 130 may further include a first inner downstream point 188 formed at an intersection between the first aperture downstream edge 182 and the first inner surface portion 118.

A ligament length 194 between the inner surface edge 124 and the first inner downstream point 188 of each first aperture 130 may be measured along the first axis 108. In some embodiments, the ligament length 194 is greater than 0 mm. This may ensure that each first aperture 130 is positioned on the first inner surface portion 118.

A rail distance 196 between the rear rail 60 and the first inner upstream point 186 of each first aperture 130 may be measured along the first axis 108. In some embodiments, the rail distance 196 may be greater than 0 mm. This may prevent the rear rail 60 from blocking each first aperture 130, so that each first aperture 130 supplies the cooling fluid efficiently to the annular rear lip 64.

A distance 198 between the inner downstream edge 62 and the first inner downstream point 188 of each first aperture 130 may be measured along the lip axis 66. In some embodiments, distance 198 may be greater than 0 mm. The distance 198 may ensure that the cooling fluid supplied by each first aperture 130 directly impinges onto the inner wall 52, or more specifically onto the cold side of the annular rear lip 64.

The lip overhang length 190 may be influenced by the lip extension distance 192, the ligament length 194, and the rail distance 196. The lip overhang length 190 may also be influenced by the distance 198 and the rail distance 196.

Various examples have been described, each of which comprise various combinations of features. It will be appreciated by those skilled in the art that, except where clearly mutually exclusive, any of the features may be employed separately or in combination with any other features and the invention extends to and includes all combinations and sub-combinations of one or more features described herein.

We claim:

1. A cooling ring for a combustor system having an inner wall, an outer wall spaced apart from the inner wall, and one or more discharge nozzles disposed downstream of the inner wall, the cooling ring comprising:

an inner surface at least partially facing the inner wall and extending circumferentially about a central axis of the cooling ring;

an outer surface radially spaced apart from the inner surface and facing away from the inner wall;

an upstream portion extending along a first axis and disposed adjacent to the outer wall, wherein the upstream portion abuts an outer downstream edge of the outer wall;

a downstream portion spaced apart from the upstream portion and extending along a second axis that is obliquely inclined to the first axis by a first inclination angle, wherein the downstream portion extends beyond an inner downstream edge of the inner wall with respect to the second axis; and a middle portion connecting the upstream portion to the downstream portion, the middle portion, the upstream portion, and the downstream portion together forming the inner surface and the outer surface, the middle portion comprising:

a first inner surface portion adjacent to the upstream portion and partly forming the inner surface, wherein the first inner surface portion extends along the first axis and faces the inner wall, and wherein the first inner surface portion supports a rear rail of the inner wall;

a second inner surface portion partly forming the inner surface, wherein the second inner surface portion extends from the first inner surface portion to the downstream portion along a third axis that is inclined to the first axis by a second inclination angle greater than the first inclination angle;

an inner surface edge formed at an intersection between the first inner surface portion and the second inner surface portion;

an outer surface portion partly forming the outer surface and extending between the upstream portion and the downstream portion;

a plurality of first apertures circumferentially spaced apart from each other with respect to the central axis and extending through the middle portion, wherein each first aperture from the plurality of first apertures extends from the first inner surface portion to the outer surface portion along a first aperture axis, wherein each first aperture is disposed between the rear rail of the inner wall and the inner surface edge with respect to the first axis, and wherein each first aperture is configured to supply a cooling fluid to a cavity defined between the inner wall and the cooling ring downstream of the rear rail of the inner wall;

a plurality of second apertures circumferentially spaced apart from each other with respect to the central axis and extending through the middle portion, wherein each second aperture from the plurality of second apertures extends from the second inner surface portion to the outer surface portion along a second aperture axis that is inclined to the first aperture axis by a third inclination angle, and wherein each second aperture is spaced apart from each first aperture and is configured to supply the cooling fluid to the one or more discharge nozzles; and wherein each first aperture has a first diameter, and wherein each second aperture has a second diameter that is larger than the first diameter.

2. The cooling ring of claim 1, wherein the plurality of first apertures and the plurality of second apertures are staggered from each other, such that each first aperture is circumferentially disposed between a pair of adjacent second apertures from the plurality of second apertures with respect to the central axis.

3. The cooling ring of claim 1, wherein the second diameter is from 2.1 mm to 2.3 mm.

4. The cooling ring of claim 1, wherein the downstream portion has a ring downstream edge distal to the middle portion, wherein each second aperture defines a centre formed at an intersection between the second aperture axis and a plane of the second inner surface portion, and wherein a central axial distance between the ring downstream edge and the center of each second aperture measured along the second axis is from 14.32 mm to 14.36 mm.

5. The cooling ring of claim 1, wherein an angle between the second aperture axis of each second aperture and a normal to the second axis is from 48 degrees to 52 degrees.

6. The cooling ring of claim 1, wherein each second aperture comprises a second aperture upstream edge disposed proximal to the inner surface edge, a second aperture downstream edge disposed distal to the inner surface edge, a second inner upstream point formed at an intersection between the second aperture upstream edge and the second inner surface portion, a second inner downstream point formed at an intersection between the second aperture downstream edge and the second inner surface portion, and a second outer upstream point formed at an intersection between the second aperture upstream edge and the outer surface portion.

7. The cooling ring of claim 6, wherein the downstream portion comprises a downstream inner surface portion that partly forms the inner surface, the downstream inner surface portion comprising an upstream boundary that is perpendicular to the second axis and demarcates the downstream inner surface portion from the second inner surface portion, and wherein a downstream axial distance between the upstream boundary and the second inner downstream point of each second aperture measured along the second axis is 0.732 mm.

8. The cooling ring of claim 6, wherein an inner distance between the inner surface edge and the second inner upstream point of each second aperture measured along the third axis is from 0.7 mm to 1.27 mm.

9. The cooling ring of claim 6, wherein the outer surface comprises a rounded interface extending from the outer surface portion to the upstream portion, wherein the rounded interface comprises an interface upstream edge disposed adjacent to the upstream portion and an interface downstream edge disposed adjacent to the outer surface portion.

10. The cooling ring of claim 1, wherein each first aperture comprises a first aperture downstream edge disposed proximal to the inner surface edge, a first aperture upstream edge disposed distal to the inner surface edge, a first inner upstream point formed at an intersection between the first aperture upstream edge and the first inner surface portion, and a first inner downstream point formed at an intersection between the first aperture downstream edge and the first inner surface portion.

11. A combustor system for a gas turbine engine, the combustor system comprising:

an inner wall comprising at least one row of combustor tiles, a rear rail extending radially outwards, an inner downstream edge spaced apart from the rear rail, and an annular rear lip extending between the rear rail and the inner downstream edge along a lip axis;

an outer wall spaced apart from the inner wall, the outer wall comprising an outer downstream edge;

one or more discharge nozzles disposed downstream of the inner wall; and a cooling ring connected to the outer wall, the cooling ring comprising:

an inner surface at least partially facing the inner wall and extending circumferentially about a central axis of the cooling ring;

an outer surface radially spaced apart from the inner surface and facing away from the inner wall;

an upstream portion extending along a first axis and disposed adjacent to the outer wall, wherein the upstream portion abuts an outer downstream edge of the outer wall;

a downstream portion spaced apart from the upstream portion and extending along a second axis that is obliquely inclined to the first axis by a first inclination angle, wherein the downstream portion extends beyond an inner downstream edge of the inner wall with respect to the second axis; and a middle portion connecting the upstream portion to the downstream portion, the middle portion, the upstream portion, and the downstream portion together forming the inner surface and the outer surface, the middle portion comprising:

a first inner surface portion adjacent to the upstream portion and partly forming the inner surface, wherein the first inner surface portion extends along the first axis and faces the inner wall, wherein the first inner surface portion supports the rear rail of the inner wall, and wherein the annular rear lip and the first inner surface portion define a cavity therebetween;

a second inner surface portion partly forming the inner surface, wherein the second inner surface portion extends from the first inner surface portion to the downstream portion along a third axis that is inclined to the first axis by a second inclination angle greater than the first inclination angle;

an inner surface edge formed at an intersection between the first inner surface portion and the second inner surface portion;

an outer surface portion partly forming the outer surface and extending between the upstream portion and the downstream portion;

a plurality of first apertures circumferentially spaced apart from each other with respect to the central axis and extending through the middle portion, wherein each first aperture from the plurality of first apertures extends from the first inner surface portion to the outer surface portion along a first aperture axis, wherein each first aperture is disposed between the rear rail of the inner wall and the inner surface edge with respect to the first axis, and wherein each first aperture is configured to supply a cooling fluid to a cavity between the annular rear lip and the first inner surface portion;

a plurality of second apertures circumferentially spaced apart from each other with respect to the central axis and extending through the middle portion, wherein each second aperture from the plurality of second apertures extends from the second inner surface portion to the outer surface portion along a second aperture axis that is inclined to the first aperture axis by a third inclination angle, and wherein each second aperture is spaced apart from each first aperture and is configured to supply the cooling fluid to the one or more discharge nozzles; and wherein each first aperture has a first diameter, and wherein each second aperture has a second diameter that is larger than the first diameter.

12. The combustor system of claim 11, wherein the plurality of first apertures and the plurality of second apertures are staggered from each other, such that each first aperture is circumferentially disposed between a pair of adjacent second apertures from the plurality of second apertures with respect to the central axis.

13. The combustor system of claim 11, wherein the downstream portion has a ring downstream edge distal to the middle portion, wherein each second aperture defines a centre formed at an intersection between the second aperture axis and a plane of the second inner surface portion, and wherein a central axial distance between the ring downstream edge and the center of each second aperture measured along the second axis is from 14.32 mm to 14.36 mm.

14. The combustor system of claim 11, wherein each second aperture comprises a second aperture upstream edge disposed proximal to the inner surface edge, a second aperture downstream edge disposed distal to the inner surface edge, a second inner upstream point formed at an intersection between the second aperture upstream edge and the second inner surface portion, a second inner downstream point formed at an intersection between the second aperture downstream edge and the second inner surface portion, and a second outer upstream point formed at an intersection between the second aperture upstream edge and the outer surface portion.

15. The combustor system of claim 11, wherein each discharge nozzle from the one or more discharge nozzles comprises a birdmouth cavity that at least partially receives the downstream portion of the cooling ring therein.

16. The combustor system of claim 11, wherein the annular rear lip has a lip overhang length between the rear rail and the inner downstream edge measured along the lip axis, and wherein the lip overhang length is at most 8.4 mm.

17. The combustor system of claim 11, wherein each first aperture comprises a first aperture downstream edge disposed proximal to the inner surface edge, a first aperture upstream edge disposed distal to the inner surface edge, a first inner upstream point formed at an intersection between the first aperture upstream edge and the first inner surface portion, and a first inner downstream point formed at an intersection between the first aperture downstream edge and the first inner surface portion.

18. A cooling ring for a combustor system having an inner wall, an outer wall spaced apart from the inner wall, and one or more discharge nozzles disposed downstream of the inner wall, the cooling ring comprising:

an inner surface at least partially facing the inner wall and extending circumferentially about a central axis of the cooling ring;

an outer surface radially spaced apart from the inner surface and facing away from the inner wall;

an upstream portion extending along a first axis and disposed adjacent to the outer wall, wherein the upstream portion abuts an outer downstream edge of the outer wall;

a downstream portion spaced apart from the upstream portion and extending along a second axis that is obliquely inclined to the first axis by a first inclination angle, wherein the downstream portion extends beyond an inner downstream edge of the inner wall with respect to the second axis; and a middle portion connecting the upstream portion to the downstream portion, the middle portion, the upstream portion, and the downstream portion together forming the inner surface and the outer surface, the middle portion comprising:

a first inner surface portion adjacent to the upstream portion and partly forming the inner surface, wherein the first inner surface portion extends along the first axis and faces the inner wall, and wherein the first inner surface portion supports a rear rail of the inner wall;

a second inner surface portion partly forming the inner surface, wherein the second inner surface portion extends from the first inner surface portion to the downstream portion along a third axis that is inclined to the first axis by a second inclination angle greater than the first inclination angle;

an inner surface edge formed at an intersection between the first inner surface portion and the second inner surface portion;

an outer surface portion partly forming the outer surface and extending between the upstream portion and the downstream portion;

a plurality of first apertures circumferentially spaced apart from each other with respect to the central axis and extending through the middle portion, wherein each first aperture from the plurality of first apertures extends from the first inner surface portion to the outer surface portion along a first aperture axis, wherein each first aperture is disposed between the rear rail of the inner wall and the inner surface edge with respect to the first axis, and wherein each first aperture is configured to supply a cooling fluid to a cavity defined between the inner wall and the cooling ring downstream of the rear rail of the inner wall;

a plurality of second apertures circumferentially spaced apart from each other with respect to the central axis and extending through the middle portion, wherein each second aperture from the plurality of second apertures extends from the second inner surface portion to the outer surface portion along a second aperture axis that is inclined to the first aperture axis by a third inclination angle, and wherein each second aperture is spaced apart from each first aperture and is configured to supply the cooling fluid to the one or more discharge nozzles; and wherein an angle between the second aperture axis of each second aperture and a normal to the second axis is from 48 degrees to 52 degrees.

* * * * *